US006334841B1

(12) United States Patent
Letourneur

(10) Patent No.: US 6,334,841 B1
(45) Date of Patent: Jan. 1, 2002

(54) CENTRIFUGE WITH RANQUE VORTEX TUBE COOLING

(75) Inventor: Jean Claude Letourneur, Pornichet (FR)

(73) Assignee: Jouan, Saint-Herblain (FR)

( * ) Notice: Subject to any disclaimer, the term of this patent is extended or adjusted under 35 U.S.C. 154(b) by 0 days.

(21) Appl. No.: 09/516,029

(22) Filed: Feb. 29, 2000

(30) Foreign Application Priority Data

Mar. 1, 1999 (FR) ..... 99 02512

(51) Int. Cl.[7] ..... B04B 5/02; B04B 9/06; B04B 15/02

(52) U.S. Cl. ..... 494/11; 494/12; 494/14; 494/16; 494/24; 494/25; 494/36; 494/84; 62/5

(58) Field of Search ..... 494/11–14, 16, 494/20, 23, 24, 26, 36, 84, 25; 62/5; 210/175, 179

(56) References Cited

U.S. PATENT DOCUMENTS 731,215 A * 6/1903 Patterson
773,220 A * 10/1904 Patterson
1,952,281 A * 3/1934 Ranque ..... 62/5
1,989,213 A * 1/1935 Schenck
2,209,723 A * 7/1940 Ayres ..... 494/24
2,733,857 A * 2/1956 Beams
2,875,949 A * 3/1959 Tarsoly
2,885,188 A * 5/1959 Pickels et al.
2,899,131 A * 8/1959 Wohler
3,108,955 A * 10/1963 Boyland
3,129,174 A * 4/1964 Pickels et al.
3,246,688 A * 4/1966 Colburn
3,277,238 A * 10/1966 Sharp et al.
3,430,849 A * 3/1969 Gibson et al.
3,654,768 A * 4/1972 Inglis et al. ..... 62/5
3,958,753 A * 5/1976 Durland et al.
4,030,897 A * 6/1977 Pelzer et al.
4,036,428 A 7/1977 Durland et al.
4,193,536 A 3/1980 Kubota
4,406,651 A * 9/1983 Dudrey et al.
4,941,866 A * 7/1990 Gorodissky et al. ..... 494/14
5,010,736 A * 4/1991 York et al. ..... 62/5
5,280,975 A * 1/1994 Tscheu et al. ..... 494/12
6,241,650 B1 * 6/2001 Letourneur

FOREIGN PATENT DOCUMENTS

CH 648 769 4/1985
DE 1 034 550 7/1958

* cited by examiner

*Primary Examiner*—Charles E. Cooley
(74) *Attorney, Agent, or Firm*—Larson & Taylor

(57) ABSTRACT

This centrifuge includes a chamber (5), a rotor (6) arranged therein, a device (8) for driving the rotation of the rotor, and a device (11) for cooling the atmosphere of the chamber. The device for cooling the atmosphere of the chamber includes a Ranque vortex tube (30), a cold outlet (33) which is connected to one inlet (66) of the chamber. The centrifuge includes a pressurized-gas supply circuit which is connected to an inlet (32) of the Ranque vortex tube and which is intended to be connected to a source (49) of pressurized gas. Application is to the centrifuging of biological products.

19 Claims, 5 Drawing Sheets

CENTRIFUGE WITH RANQUE VORTEX TUBE COOLING

FIELD OF THE INVENTION

The present invention relates to a centrifuge comprising a chamber, a rotor arranged therein, means for driving the rotation of the rotor, and means for cooling the atmosphere of the chamber.

The invention applies in particular to the centrifuging of biological products.

BACKGROUND OF THE INVENTION

The cooling of the atmosphere of the chamber of a centrifuge of this type is generally achieved by cooling a wall of the chamber, for example by causing a cooling fluid to circulate on the outside of the chamber, or by using a Peltier-effect system.

However, it is found that these methods of cooling are not very effective and/or generate a significant amount of heat outside the chamber.

The latter aspect is particularly troublesome in the case of the centrifuging of products likely to release pathogenic or toxic substances, it being necessary for such centrifuging to be performed in specially appointed rooms. The volume of these rooms, which meet, for example, the type P3 or P4 confinement standards, is limited and numerous items of apparatus giving off large amounts of heat are generally gathered in these rooms. Now, such release of large amounts of heat is detrimental to the correct operation of these items of apparatus, to their life, and to the results of the manipulations.

BRIEF SUMMARY OF THE INVENTION

The object of the invention is to solve these problems by providing a centrifuge in which the cooling means are effective and lead to a limited production of heat outside the chamber.

To this end, the subject of the invention is a centrifuge comprising a chamber, a rotor arranged therein, means for driving the rotation of the rotor, and means for cooling the atmosphere of the chamber, characterized in that the means for cooling the atmosphere of the chamber comprise a Ranque vortex tube, a cold outlet of which is connected to one inlet of the chamber, and in that the centrifuge comprises a pressurized-gas supply circuit which is connected to an inlet of the Ranque vortex tube and which is intended to be connected to a source of pressurized gas.

According to particular embodiments, the centrifuge may comprise one or more of the following features, taken in isolation or in any technically feasible combination:

- the centrifuge comprises a gas-purification unit, one inlet of this unit being connected to an outlet for drawing gas from the chamber,
- the purification unit comprises at least one filter,
- the purification unit comprises at least one device for the chemical treatment of the drawn-off gas,
- one outlet of the said gas-purification unit is connected to a suction device,
- the means for driving the rotation of the rotor are pneumatic rotational-drive means connected to the pressurized-gas supply circuit,
- the pneumatic rotational-drive means comprise a turbine,
- the suction device is controlled by the pressurized gas supplied to the pneumatic means for driving the rotation of the rotor,

- the suction device comprises a venturi injection system including an inlet for entraining fluid intended to be connected to the said source of pressurized gas, an inlet for entrained fluid connected to the said outlet of the purification unit, and an outlet for entraining fluid and entrained fluid which is connected to the pneumatic means for driving the rotation of the rotor,
- the centrifuge comprises a source of decontamination gas connected to one inlet of the chamber,
- the chamber is leak-tight,
- the centrifuge comprises a pneumatic device for braking the rotor,
- the supply circuit comprises a timer-controlled valve,
- the centrifuge comprises a door which can move between a position for access to the inside of the chamber and a closed position, the centrifuge further comprises a pneumatic device for locking the door in its closed position, which locking device is connected to the pressurized-gas supply circuit,
- the locking device comprises a first lock which can move between a position for locking and a position for unlocking the door, the first lock being secured to a rod of a first pneumatic ram connected via at least one individual pipe to the said pressurized-gas supply circuit, the locking device comprises a valve for selectively switching the individual pipe or pipes to the pressurized-gas supply circuit,
- the supply circuit comprises an automatic-locking valve which itself includes a shut-off member which can move between a position for opening and a position for closing the automatic-locking valve, one outlet of this automatic-locking valve is connected to the said switching valve, the said shut-off member is kept in the open position when the door of the centrifuge is in the closed position, and the said switching valve, when at rest, places the said outlet of the automatic-locking valve and the first ram in communication so that the first lock is driven towards its locking position,
- the automatic-locking valve is intended to be permanently connected to the said source of pressurized gas,
- the locking device comprises a second lock which can move between a position of immobilizing the first lock in its locking position and a position of releasing the first lock, and the second lock is secured to the rod of a second pneumatic ram permanently connected to one outlet of the said timer-controlled valve.

BRIEF DESCRIPTION OF THE DRAWINGS

The invention will be better understood from reading the description which will follow which is given merely by way of example and made with reference to the appended drawings, in which.

DETAILED DESCRIPTION OF THE INVENTION

Figure 1:
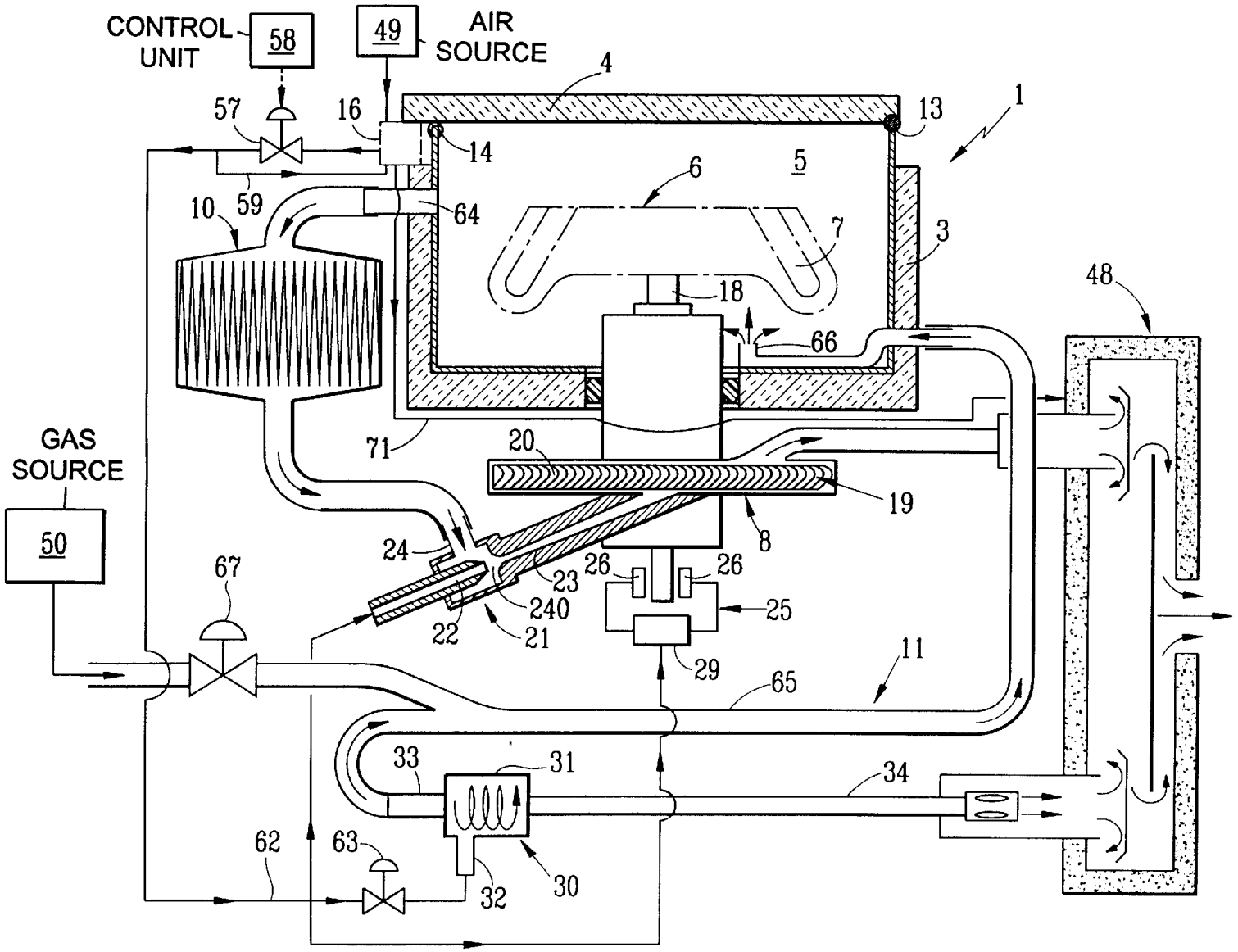
FIG. 1 is a diagrammatic side view, partially in section, of a centrifuge according to a preferred embodiment of the invention.

FIG. 1 diagrammatically depicts a centrifuge 1 which essentially comprises:

a lagged tank 3 borne by a stand (not depicted) and fitted with a door 4, the tank 3 and the door 4 forming a chamber 5, a rotor 6 arranged in the chamber 5 and equipped with housings 7 for holding containers for products to be centrifuged, pneumatic means 8 for driving the rotation of the rotor 6, a unit 10 for purifying gas drawn from the chamber 5, and means 11 for cooling the atmosphere of the chamber 5.

The door 4 is hinged at 13 to the tank 3 so that it can move between a closed position, as depicted in FIG. 1, and an open position, not depicted, for access to the inside of the chamber 5.

When the door 4 is in the closed position, the chamber 5 is rendered leak-tight with respect to the outside, particularly by virtue of a seal 14 which is compressed between the door 4 and the tank 3.

In the open position, the door 4 is raised with respect to its closed position.

The centrifuge 1 further comprises a pneumatic device 16 (in dotted line) for locking the door 4 in the closed position. This device will be described later on with reference to FIG. 3.

The drive means 8 comprise a shaft 18 secured to the rotor 6 and a turbine 19, the blades 20 of which are depicted diagrammatically in FIG. 1. This turbine 19 is secured to the shaft 18.

The drive means 8 also comprise a venturi injection system 21 which itself includes:

an injector 22 of entraining fluid, a divergent nozzle 23, the inlet of which is spaced slightly away from the outlet of the injector 22 and which opens near to the blades 20, and an inlet 24 for entrained fluid, communicating with the space 240 separating the inlet of the nozzle 23 from the outlet of the injector 22.

The centrifuge 1 also comprises a pneumatic brake which comprises (FIG. 2) two jaws 26 articulated to a shaft 27 and arranged one on each side of the shaft 18 that drives the rotor 6.

Figure 2:
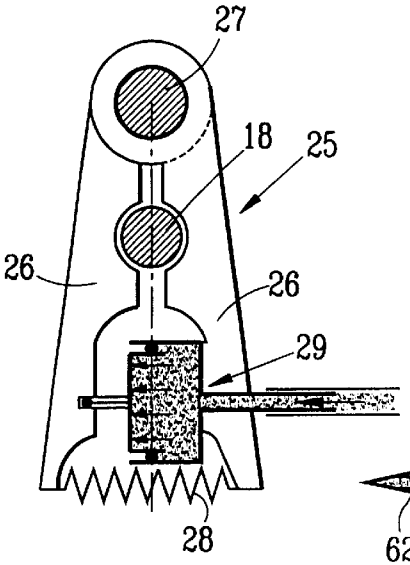
FIG. 2 is an enlarged diagrammatic view from above of the pneumatic brake of the centrifuge of FIG. 1.

These jaws 26 can move transversely to the shaft 18 between a close-together braking position (not depicted), in which they clamp the shaft 18, and a spaced-apart position, in which the shaft 18 turns freely between the jaws 26 as depicted in FIG. 2.

The brake 25 further comprises a spring 28 for returning the jaws 26 to their close-together position and a single-acting pneumatic ram 29 arranged between the jaws 26. When the pneumatic ram 29 is supplied with pressurized gas, as depicted diagrammatically in grey in FIG. 2, the jaws 26 are in the spaced-apart position. When the ram 29 is not supplied with pressurized gas, the jaws 26 are in the close-together position.

The gas-purification unit 10 comprises, for example, a filter of the HEPA type.

The means 11 for cooling the atmosphere of the chamber 5 comprise a Ranque vortex tube 30. This conventional device comprises a vortex-flow generator 31 to which are connected one inlet 32 for supplying pressurized gas, a cold outlet 33 and a hot outlet 34 for gas.

Figure 3:
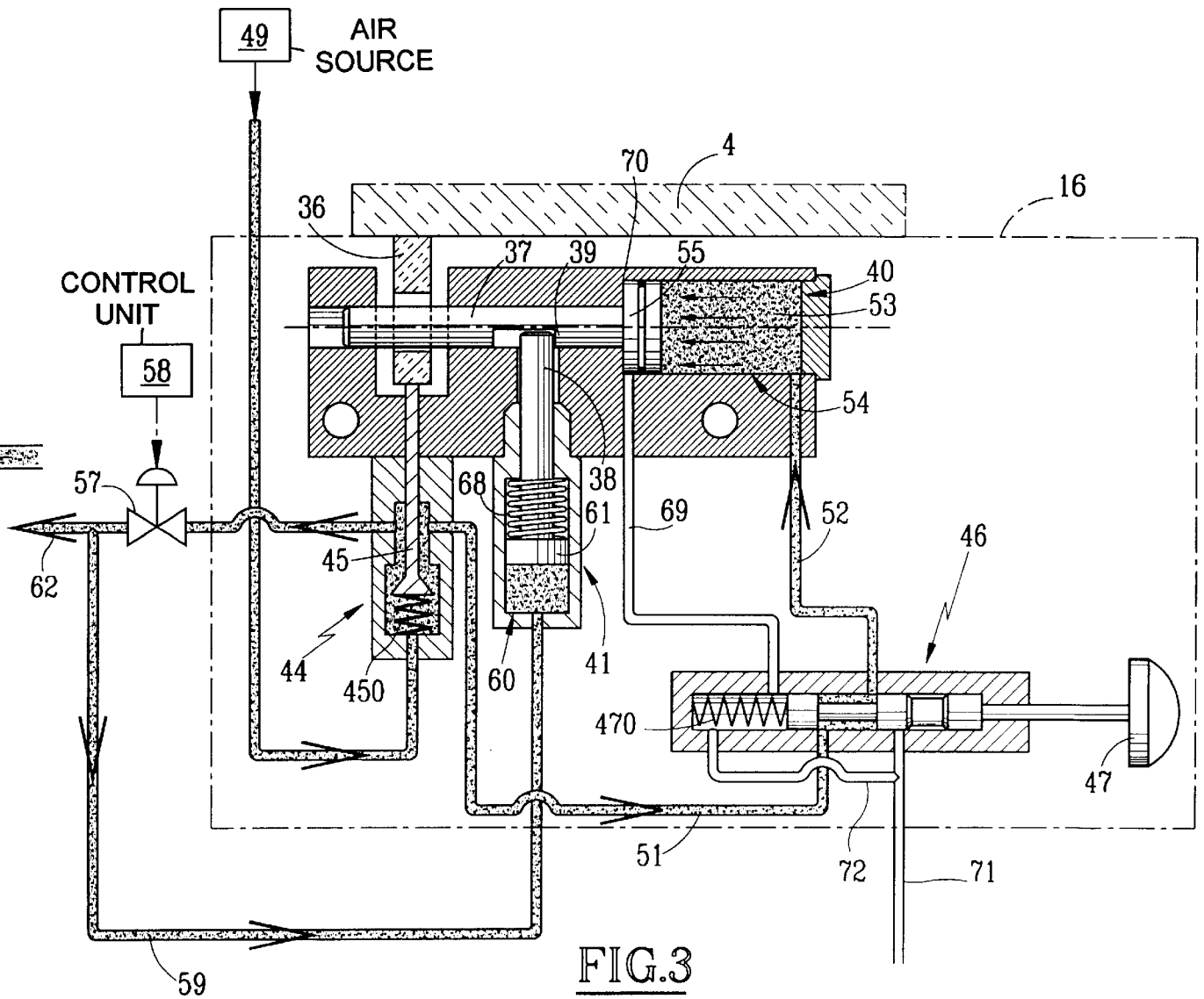
FIGS. 3. to 5 are enlarged diagrammatic views, in section, illustrating the structure and operation of the device for locking the door of the centrifuge of FIG. 1.

As illustrated in FIG. 3, the locking device 16 comprises a keeper 36 secured to the door 4, a first lock 37 and a second lock 38.

The first lock 37 can slide between a position for locking the door 4 (FIG. 3), in which the first lock is engaged in the keeper 36, and a position for unlocking the door (FIG. 5), in which the lock 37 is withdrawn from the keeper 36.

Figure 5:
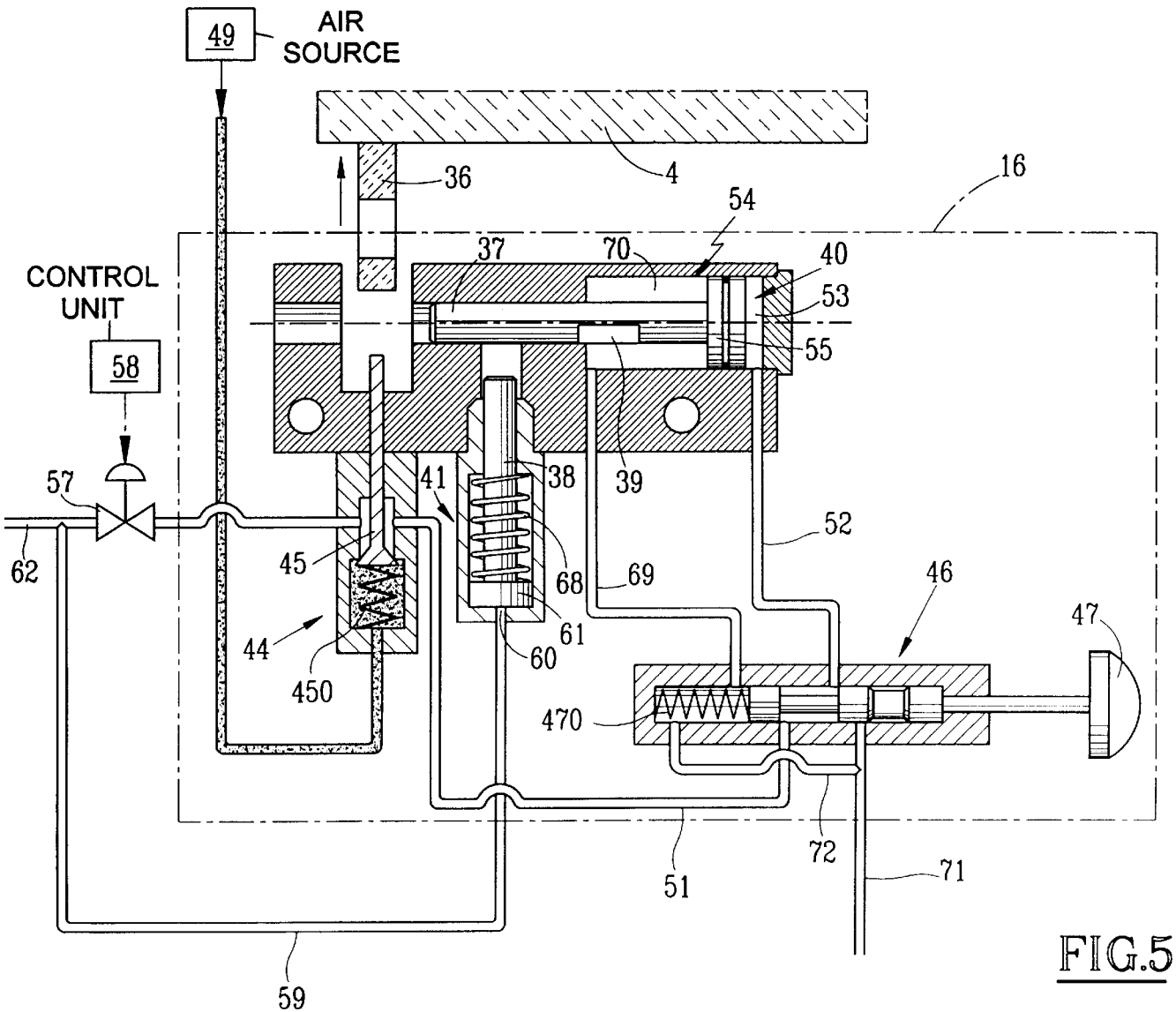

The second lock 38 can slide at right angles to the first lock between a position of immobilizing the first lock 37 in its locking position (FIG. 3), and a position of releasing the first lock 37 (FIG. 5).

In its immobilizing position, the second lock 38 is engaged in a recess 39 made in the first lock 37.

The first lock consists of the rod of a first double-acting pneumatic ram 40, and the second lock 38 consists of the rod of a second single-acting pneumatic am 41.

The pneumatic locking device 16 also comprises:

a three-way two-position automatic-locking valve 44, the shut-off member 45 of which is held in the open position, against the effect of a spring 450, by the keeper 36 of the door 4 when the latter is in the closed position, and a five-way, two-position switching valve 46, the shut-off member 47 of which can be operated manually.

The shut-off member 47 can slide between a position for unlocking the door 4, in which it compresses a spring 470, and a position for locking the door 4, or position of rest, in which the spring 470 is not compressed.

The centrifuge further comprises a silencer 48, a source 49 of pressurized air and a source 50 of decontamination gas, for example formol. The air of the source 49 is, for example, at a pressure of between 3 and 6 bar.

The structure of the fluid circuit connecting the various elements of the centrifuge 1 will become clearly apparent during the description of the operation of this centrifuge 1, which will be given, to start with, on the basis of FIGS. 1 and 3.

Figure 4:
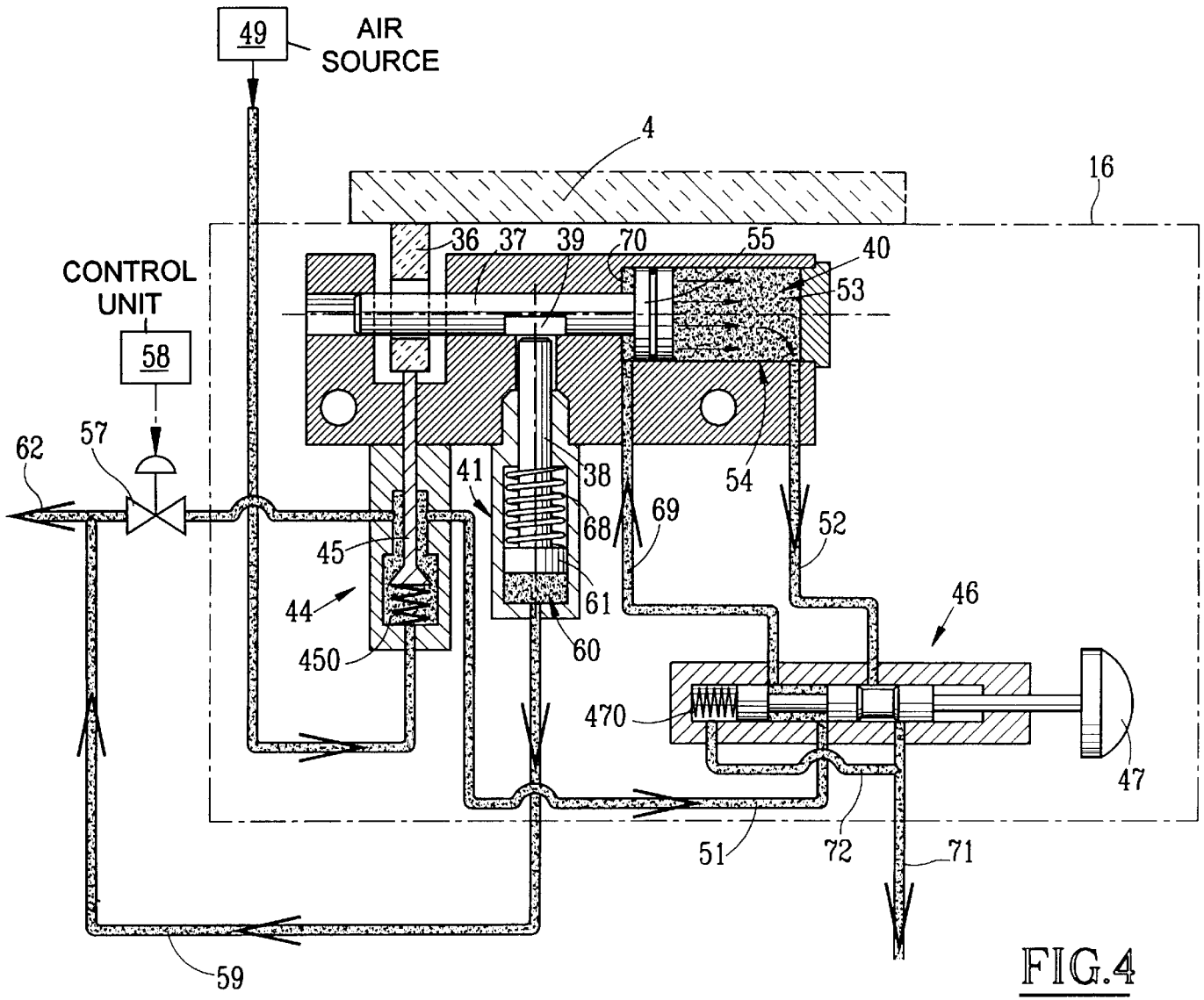

In FIG. 3, as in FIGS. 4 and 5, the inside of the pipes containing pressurized air is depicted in grey.

With the door 4 in the closed position, pressurized air from the source 49 passes through the automatic-locking valve 44, which is in the open position, and is then split into two streams.

The first of these streams is conveyed by a pipe 51 to the switching valve 46. As the shut-off member 47 is at rest, that is to say in the position for locking the door 4, this first stream is then conveyed by an individual pipe 52 to a first part 53 of the chamber 54 of the first ram 40.

This first stream pushes back the piston 55 of the first ram 40 to the left in FIG. 3, so that the first lock 37 is pushed into its position for locking the door 4.

It will be noted that when the shut-off member 47 is at rest, the first part 53 of the chamber 54 of the first ram 40 is automatically placed in communication with an outlet of the valve 44 and therefore with the source 49, so that locking of the door 4 is automatic.

The second stream from the automatic-locking valve 44 passes through a valve 57 which is timer-controlled by a control unit 58 which keeps it open during centrifuging. The control unit 58 is, for example, a pneumatic or mechanical unit.

This second stream is itself split into two streams as it leaves the valve 57.

The first of these streams is sent, via a pipe 59, to the chamber 60 of the second ram 41 so as to push the piston 61 of this ram upwards in FIG. 3, so that the second lock 38 is pushed into its position for immobilizing the first lock 37.

Thus, throughout centrifuging, that is to say as long as the valve 57 is open, the second lock 38 is in a position of immobilizing the first lock 37, and it is therefore impossible to unlock the door 4.

The second stream of pressurized air from the valve 57 is conveyed by a pipe 62 and is then supplied to (FIG. 1):

the inlet 32 of the Ranque vortex tube 30, via a manual valve 63, the ram 29 of the pneumatic brake 25, constantly, and the injector 22 of the venturi injection system 21, constantly.

Thus, throughout centrifuging, the pneumatic ram 29 of the brake 25 is supplied with pressurized air so that the jaws 26 are in the spaced-apart position and allow the shaft 18 to turn freely.

The injection of pressurized air by the injector 22 creates a depression at the periphery of the space 240 and therefore at the inlet 24 of the venturi injection system. Gas is thus drawn via an outlet 64 of the chamber 5, then filtered in the filter 10. This drawn-off and filtered gas is then sucked into the venturi injection system 21 through the inlet 24, then ejected from the nozzle 23 with the pressurized air from the injector 22, driving the turbine 19, the shaft 18 and the rotor 6.

Having driven the turbine 19, this flow of fluid is then removed to outside the centrifuge 1 via the silencer 48.

The pressure-reduced air from the hot outlet 34 of the Ranque vortex tube is also removed to outside the centrifuge 1 via the silencer 48.

The low-temperature, for example −10° C., pressure-reduced air from the cold outlet 33 of the Ranque vortex tube is conveyed by a pipe 65 to an inlet 66 of the chamber 5. The cold air is ejected from this inlet 66 under and towards the rotor 6, therefore cooling the atmosphere of the chamber 5.

It is possible, by opening a manual valve 67, to cause the decontamination gas to flow from the source 50 into the pipe 65 then into the chamber 5 and thus sweep the atmosphere of the chamber 5, of the filter 10, of the turbine 19 and of the silencer 48 with this decontamination gas.

At the end of the centrifuging cycle, the valve 57 is automatically closed by the control unit 58. As the pneumatic ram 29 of the brake 25 is no longer supplied with pressurized air, the jaws 26 will automatically position themselves in the close-together position for braking the rotor 6.

As illustrated by FIG. 4, the pressurized air contained in the chamber 60 of the second ram 41 is removed by the pipe 59 then by the pipe 62 to the silencer 48, and the piston 61 of the second ram 41 is pushed back by a spring 68. Thus, the second lock 38 is returned to its position of releasing the first lock 37.

By manually bringing the shut-off member 47 of the switching valve 46 into its unlocking position, the pipe 51 is therefore placed in communication, via an individual pipe 69, with a second part 70 of the chamber 54 of the first double-acting ram 40. Thus, this second part 70 of the chamber 54 is supplied with pressurized air because the automatic-locking valve 44 is in the open position.

At the same time, the first part 53 of the chamber 54 is vented, via a pipe 71 (FIGS. 1 and 4) then via the silencer 48.

Thus, the piston 55 of the first ram is pushed back to the right in FIG. 1 and the first lock 37 is returned to its unlocking position.

When the first lock 37 is in the unlocking position, it is possible to open the door 4.

When the door 4 leaves its closed position (FIG. 5), the shut-off member 45 of the valve 44 is returned by the spring 450 to its position of closing the valve 44.

Now that the shut-off member 47 of the switching valve 46 has been returned to its position of rest by the spring 470, the pressurized air present in the second part 70 of the chamber 54 of the first ram 40 has been removed by, in succession, a pipe 72, the pipe 71 and the silencer 48.

The number of electrical and mechanical devices in the centrifuge 1, particularly for heating and for driving the rotation of the rotor 6, is limited.

This characteristic is particularly advantageous when centrifuging products liable to release explosive substances.

Moreover, the combination of the pneumatic means 8 for driving the rotor 6 and the unit 10 for purifying the gas drawn from the chamber 5, in which the circulation of drawn-off gas is brought about by the pressurized air driving the turbine 19, makes it possible simultaneously to drive the rotor 6 and to filter the atmosphere of the chamber 5. Thus, the centrifuge 1 is suited to the centrifuging of dangerous products by limiting the risks of these substances being emitted to outside the centrifuge 1.

It is to be noted that the use of the venturi injection system 21 delivering, at output, a flow rate of gas which is greater than that with which the injector 22 is supplied, allows the turbine 19 and therefore the rotor 6 to be driven at relatively high speeds.

Furthermore, the possibility of decontaminating the atmosphere of the chamber further limits the risks associated with the centrifuging of such products.

The use of an injection of cold gas, particularly one obtained using a Ranque vortex tube, allows satisfactory cooling of the atmosphere of the chamber 5, with good efficiency and limiting the emissions of heat to outside the chamber 5. What is more, the use of the Ranque vortex tube makes it possible to limit the size of the means 11 for cooling the atmosphere of the chamber 5.

It will also be noted that the use of a turbine 19 for driving the rotor 6 makes it possible to limit the emissions of heat to outside the chamber 5.

According to an alternative form which has not been depicted, the gas-purification unit 10 comprises a device for the chemical treatment of gases drawn from the chamber 5, which allows the dangerous substances likely to be released by the products being centrifuged to be neutralized.

Figure 6:
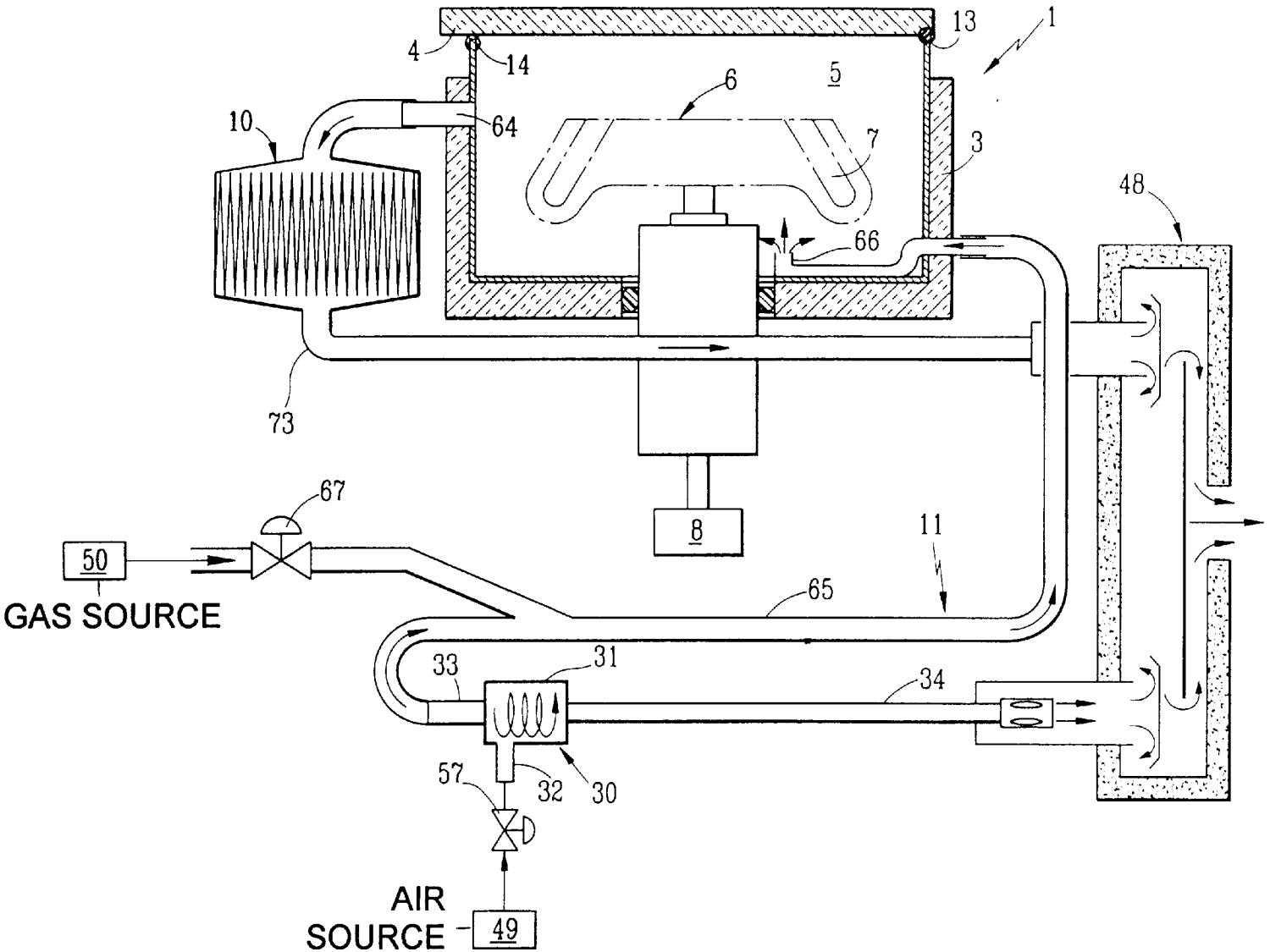
FIG. 6 is a view similar to FIG. 1 illustrating another embodiment.

FIG. 6 illustrates a simplified embodiment of a centrifuge 1.

In this embodiment, in which the locking device 16 has not been depicted for reasons of greater clarity, the means 8 for driving the rotation of the rotor 6 comprise, for example, an electric motor.

The outlet 73 from the unit 10 for purifying the drawn-off gas is then connected directly to the silencer 48.

The stream of cold gas from the cold outlet 33 of the Ranque vortex tube 30, possibly mixed with the decontamination gas from the source 50, is injected into the chamber 5 under the rotor 6, cooling the atmosphere of the chamber 5. This gas stream also creates an overpressure in the chamber 5, which means that, since the chamber 5 is leak-tight, this overpressure causes gas to be drawn off via the outlet 64 of the chamber 5.

The drawn-off gas is then purified by the purification unit 10, then removed via the silencer 48.

This centrifuge 1 can be used for centrifuging toxic non-explosive substances.

In another embodiment, not depicted, the outlet 64 from the tank 3 is vented directly, the centrifuge comprising no purification unit 10.

The latter embodiment is particularly well suited to the centrifuging of products which do not release dangerous substances.

I claim:

1. Centrifuge comprising:

a chamber having an atmosphere therein and an inlet to the atmosphere, a rotor arranged in the atmosphere of said chamber, driving means for driving said rotor in rotation, cooling means for cooling the atmosphere of the chamber, wherein the cooling means for cooling the atmosphere of the chamber comprises a Ranque vortex tube having an inlet and a cold outlet for a cooling gas which said cold outlet is connected to said inlet of the chamber in order to introduce the cooling gas into the atmosphere of the chamber, and a pressurized-gas supply circuit which is connected to said inlet of the Ranque vortex tube and which is connected to a source of pressurized gas.

2. Centrifuge according to claim 1, further comprising a gas-purification unit having an inlet connected to an outlet of the chamber for drawing gas from the chamber.

3. Centrifuge according to claim 2, wherein the purification unit comprises at least one filter.

4. Centrifuge according to claim 2, wherein the purification unit comprises at least one device for the chemical treatment of the drawn-off gas.

5. Centrifuge according to claim 2, wherein an outlet of the gas-purification unit is connected to a suction device.

6. Centrifuge according to claim 1, wherein the means for driving the rotation of the rotor are pneumatic rotational-drive means connected to the pressurized-gas supply circuit.

7. Centrifuge according to claim 6, wherein the pneumatic rotational-drive means comprise a turbine.

8. Centrifuge according to claim 6, wherein the suction device is controlled by the pressurized gas supplied to the pneumatic rotational-drive means for driving the rotation of the rotor.

9. Centrifuge according to claim 8, wherein the suction device comprises a venturi injection system including an inlet for entraining fluid intended to be connected to the source of pressurized gas, an inlet for entrained fluid connected to the outlet of the purification unit, and an outlet for entraining fluid and entrained fluid which is connected to the pneumatic rotational-drive means for driving the rotation of the rotor.

10. Centrifuge according to claim 1, further comprising a source of decontamination gas connected to an inlet of the chamber.

11. Centrifuge according to claim 1, wherein the chamber is leaktight.

12. Centrifuge according to claim 1, further comprising a pneumatic device for braking the rotor.

13. Centrifuge according to claim 1, wherein the supply circuit comprises a timer-controlled valve.

14. Centrifuge according to claim 1, further comprising a door which can move between a position for access to an inside of the chamber and a closed position, and a pneumatic device for locking the door in its closed position, which pneumatic locking device is connected to the pressurized-gas supply circuit.

15. Centrifuge according to claim 14, wherein the locking device comprises a first lock which can move between a position for locking and a position for unlocking the door, the first lock being secured to a rod of a first pneumatic ram connected via at least one individual pipe to the pressurized-gas supply circuit, and a valve for selectively switching the at least one individual pipe to the pressurized-gas supply circuit.

16. Centrifuge according to claim 15, wherein the supply circuit comprises an automatic-locking valve which includes a shut-off member which can move between a position for opening and a position for closing the automatic-locking valve, wherein one outlet of said automatic-locking valve is connected to the switching valve, wherein the shut-off member is kept in the open position when the door of the centrifuge is in the closed position, and wherein the switching valve, when at rest, places the outlet of the automatic-locking valve and the first ram in communication so that the first lock is driven towards the locking position thereof.

17. Centrifuge according to claim 16, wherein the automatic-locking valve is intended to be permanently connected to the source of pressurized gas.

18. Centrifuge according to claim 15, wherein the locking device comprises a second lock which can move between a position of immobilizing the first lock in the locking position thereof and a position of releasing the first lock, and in that the second lock is secured to the rod of a second pneumatic ram permanently connected to one outlet of a timer-controlled valve for the supply circuit.

19. Centrifuge according to claim 1, wherein the inlet of the chamber is disposed to exhaust the cooling gas flowing therethrough into direct heat exchange relationship with the rotor.

* * * * *